United States Patent [19]

Kuban

[11] 4,259,815

[45] Apr. 7, 1981

[54] BLADE SHARPENER

[75] Inventor: William G. Kuban, Columbia Heights, Minn.

[73] Assignee: Kurt Manufacturing Company, Inc., Minneapolis, Minn.

[21] Appl. No.: 73,008

[22] Filed: Sep. 6, 1979

[51] Int. Cl.[3] ..... B24B 3/54

[52] U.S. Cl. ..... 51/205 R; 51/211 R; 76/86

[58] Field of Search ..... 51/205 R, 211 R, 211 H, 51/212, 214; 76/84, 86

[56] References Cited

U.S. PATENT DOCUMENTS

| | | | |
|---|---|---|---|
| 538,404 | 4/1895 | Benesh | 76/86 |
| 1,282,705 | 10/1918 | Morche | 76/86 |
| 2,674,072 | 4/1954 | Lohmann | 51/211 R |
| 3,894,362 | 7/1975 | Graves | 51/211 R |
| 3,942,394 | 3/1976 | Juranitch | 76/84 |

*Primary Examiner*—Gary L. Smith

*Attorney, Agent, or Firm*—Kinney, Lange, Braddock, Westman and Fairbairn

[57] ABSTRACT

A blade sharpener includes a handle to which first and second sharpening members are pivotally attached. The handle has first and second receiving slots for the first and second sharpening members, each slot being on a side opposite the other within the handle. The sharpening members are capable of pivoting from a slot engaging position to an upwardly inclined position, the upwardly inclined position being defined by engagement of a stop within the handle. The sharpening members are inclined in opposite directions resulting in their upper portions being in a spaced relationship. When the blade sharpener is not in use, the sharpening members are pivoted into their respective receiving slots forming a compact unit for storage.

7 Claims, 4 Drawing Figures

BLADE SHARPENER

BACKGROUND OF THE INVENTION

1. Field of the Invention

The present invention relates to blade sharpeners and in particular to blade sharpeners that can be folded into a compact unit.

2. Description of the Prior Art

Knives and other blades have been typically hand sharpened using one hand held sharpening stone. The stone is held directly in one hand and the knife's sharp edge is rubbed against the stone. This is a dangerous method of sharpening knives since the blade can slip from the stone and cut the hand holding the stone. Further, the knife must be turned in the hand continuously to sharpen both sides of the knife blade when using a single stone, which results in a tedious task.

A pair of sharpening stones attached to the same base, whereby the knife blade is drawn along the sharpening stone in a downward direction has solved the abovementioned problem. One such sharpener is described in the Lohmann U.S. Pat. No. 2,674,072 wherein a pair of sharpening stones are fixed to diverging arms which are in turn affixed to a base member. This sharpener has the drawback of being bulky and a problem to store, due to the diverging arms.

An attempt to reduce the bulkiness of such a double stone sharpener is taught in the Graves U.S. Pat. No. 3,894,362 in which ceramic rods are placed in holds drilled in an elongated base. After use, the ceramic rods are taken out of the base and stored in an unattached relationship with the base. The unattached rods are easily lost or misplaced.

SUMMARY OF THE INVENTION

The blade sharpener of the present invention includes a handle with a first and second sharpening stone member pivotally attached to the handle. The first and second sharpening stone members pivot in parallel planes adjacent to each other. The handle has a first receiving slot and a second receiving slot, each slot being on opposite sides of the handle. The first sharpening stone member is capable of pivoting the first receiving slot to an inclined position against a first stop in the handle. The second sharpening stone member is capable of pivoting from the second receiving slot on the opposite side of the handle to the same side of the handle as the first sharpening stone member to a position inclined in opposite directions from a vertical plane than the first sharpening stone member, against a second stop in the handle. The sharpening stone members diverge from their pivotal connection and are in a spaced relationship at their upper portions.

DESCRIPTION OF THE PREFERRED EMBODIMENT

Figure 1:
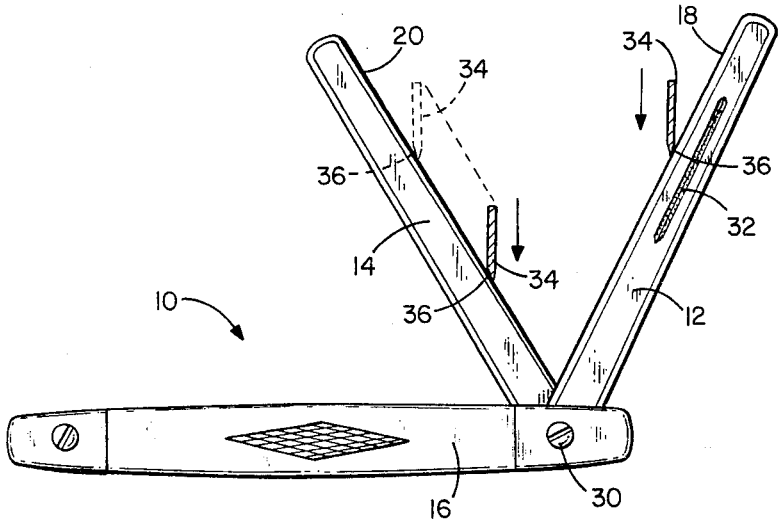
FIG. 1 is a front elevational view of the device of the present invention.

The compact blade sharpener of the present invention is generally indicated at 10 in FIG. 1. A first sharpening stone member 12 and a second sharpening stone member 14 are pivotally attached to the handle 16 at pivot point 30 with a suitable pin. The first and second sharpening stone members are preferably adjacent to each other at the pivot point 30. The sharpening members are preferably elongated bars with their stone or grit sharpening surfaces 18, 20 facing each other.

Figure 2:
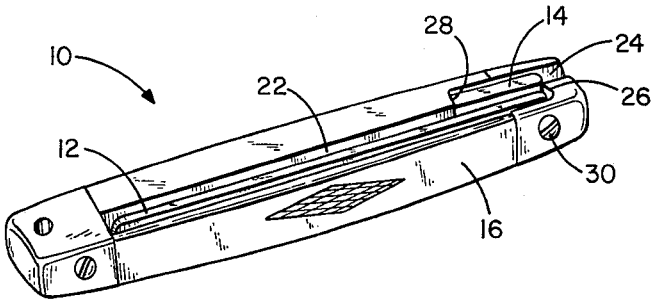
FIG. 2 is a perspective view showing the present invention in its compact form with the sharpening stones folded.

The handle 16 has a first receiving slot 22 into which sharpening stone member 12 may be folded and totally received as shown in FIG. 2. A second receiving slot 24, is only partially shown and receives sharpening stone member 14 on the side of the handle 16 opposite the first receiving slot 22. When stone member 14 is folded into the handle, the slot 24 in the handle 16 is open toward the bottom of the handle as viewed in FIGS. 2 and 3. As shown in FIG. 2, the present invention 10 is in its compact form for storage.

Figure 3:
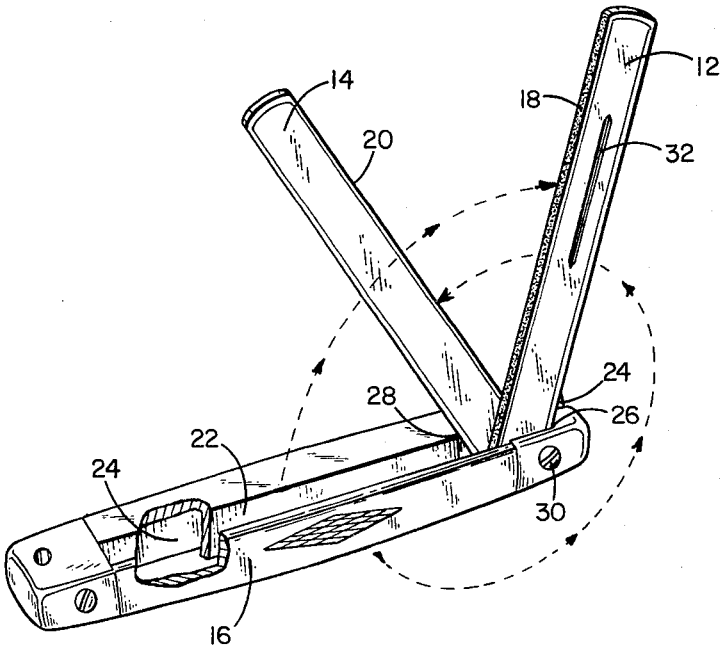
FIG. 3 is a perspective view showing the sharpening stone members in the stop engaging or working position with parts broken away.

The first sharpening stone member 12 is capable of pivoting from receiving slot 22 to an upwardly inclined position against the first stop 26, as shown in FIG. 3 by the associated dashed arrows. The second sharpening stone member 14 is capable of pivoting from the downwardly open second receiving slot 24, on the opposite side of the handle from the first receiving slot 22, to an upwardly inclined position against stop 28, as shown by the associated dashed arrows. The device of the present invention is in a sharpening or usable mode when the two stone members are in their inclined positions against the stops 26, 28. The two sharpening stone members, when in the sharpening position, diverge from pivot axis 30 so that their upper portions are in a spaced relationship and diverge at substantially equal angles on opposite sides of a vertical plane.

The sharpening stone member 14, as shown, pivots more than 270°, but less than 360°, from its folded to its usable position, while stone member 12 pivots more than 90°, but less than 180° from its folded to its usable position.

The first and second sharpening stone members 12, 14 pivot about the pivot axis 30 preferably on a pin near one end of the handle 16. The capability of the sharpening stone members to pivot into their respective receiving slots provides for a compact folding sharpening device that is easily stored. With the sharpening stone members attached to the handle, they cannot be easily lost or misplaced.

Figure 4:
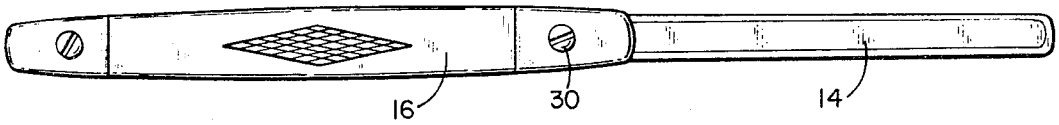
FIG. 4 is a side elevational view of the device of FIG. 1 in another operative position.

FIG. 4 shows another sharpening mode of the device of the present invention. The sharpening member 14 can be pivoted to extend outwardly, lying in the same plane as the handle 16. This allows the present invention to be used as a traditional knife sharpener, a single sharpening stone with a handle.

Sharpening member 12 may also have a fish hook sharpener portion or groove 32 at its outside surface.

In use, the handle 16 can be held in one hand against a support (preferably a horizontal surface) and a knife or other blade 34 is held with the other hand perpendicular to the planes of the sharpening members 12, 14 as best seen in FIG. 1 (parallel to the pivot axis) and vertically when the handle 16 is rested on a horizontal surface. The knife blade 34 is then drawn downwardly and across one of the sharpening stone members so that the entire length of an edge 36 of the blade 34 contacts and is pulled across the sharpening member being used. After one side of the edge 36 of the blade 34 is drawn against one of the sharpening members, the action is then repeated on the other sharpening member. This action is alternately repeated until the knife blade is sharpened. After sharpening the knife blade, the two sharpening stone members 12, 14 are folded or pivoted along the dashed lines shown in FIG. 3 to their respective receiving slots allowing the device of the present invention to be stored as a compact unit. The edges of the sharpening stone members preferably are slightly rounded so that as the knife blade is drawn over each stone member, short line or point contact is made. The longitudinal axes of the sharpening stone members are each inclined from vertical at an angle which provides a sharp edge on a knife blade when the plane of the blade is vertical and the sharpener handle 16 is horizontal. It is thus easy to place the handle 16 on a table (horizontally) and hold the blade plane vertical while sharpening. The vertical orientation of the blade plane is easier to maintain than trying to hold the blade 34 at a proper angle relative to a flat stone. The sharpening member may be any desired cross sectional shape, such as round.

The stops 26 and 28 are edge surfaces that are positioned transverse to the longitudinal axes of the respective slots so the edges of the sharpening members abut against the stops and are prevented from further pivoting. These edge surfaces define the ends of the respective slots. The unit resembles a jack knife except the sharpening members are held in an upwardly open "V" configuration for use.

Although the present invention has been described with reference to the preferred embodiment, a person skilled in the art will recognize the changes that may be made in form and detail without departing from the spirit and scope of the invention.

What is claimed is:

1. A blade sharpener comprising:

handle means having a first receiving slot and a second receiving slot, each slot being open toward an opposite side of the handle means, and first and second stops associated with the first and second slots, respectively.

a first sharpening stone member pivotally attached to the handle means, the first sharpening stone member being capable of pivoting from a first position substantially within said first slot to an inclined position relative to the handle means against said first stop; and a second sharpening stone member pivotally attached to the handle means and being capable of pivoting from a position within said second slot to an inclined position relative to the handle against a second stop wherein the second sharpening stone member is inclined relative to the first sharpening stone member so that the upper portions of the said sharpening stone members are in a spaced relationship.

2. The blade sharpener of claim 1 wherein the first stop is defined by a surface defining the end of the first receiving slot and the second stop is defined by a surface aligned with and crossing the second receiving slot and on the same side of the handle as the first receiving slot.

3. The blade sharpener of claim 1 including a single pin mounted on the handle means and pivotally mounting the first and second sharpening stone members.

4. The blade sharpener of claim 1, wherein the first sharpening stone member pivots in a first direction about the pin to the first stop and the second sharpening stone member pivots in a second direction about the pin to the second stop.

5. The blade sharpener of claim 1 wherein the first sharpening stone member pivots adjacently to the second sharpening stone member.

6. The blade sharpener of claim 1 wherein the handle means is an elongated handle and the first sharpening stone member pivots between 90° and 180° with respect to the longitudinal axis of the handle and the second sharpening stone member pivots between 270° and 360° with respect to the longitudinal axis of the handle.

7. A blade sharpener comprising an elongated handle with a first receiving slot on one side of the handle and a second receiving slot adjacent to the first receiving slot on an opposite side of the handle, a pivot pin located at one end of the handle perpendicular to the planes of the first and second receiving slots, first and second stops associated with the first and second slots, respectively, a first sharpening stone member pivoting about the pivot pin from substantially within the first receiving slot to an upwardly inclined position against the first stop, wherein the first stop is defined by an end of the first receiving slot, and a second sharpening stone member pivoting in a direction opposite to the direction of the pivot of the first sharpening stone member about the pivot pin adjacent to the first sharpening stone member from substantially within the second receiving slot to the second stop, wherein the second stop is defined by an end of the second receiving slot, the first and second sharpening members when engaging the respective first and second stops diverging from the pivot pin and each being inclined substantially equal amounts from a vertical plane passing through the pivoting axis of the pivot pin.

* * * * *